US005526842A

United States Patent [19]

Christensen

[11] Patent Number: 5,526,842

[45] Date of Patent: Jun. 18, 1996

[54] IN-WALL RETRACTABLE VACUUM CLEANING HOSE ACCESS AND STORAGE DEVICE

[76] Inventor: Layne G. Christensen, 2638 N. 400 East, Liberty, Utah 84310

[21] Appl. No.: 428,328

[22] Filed: Apr. 25, 1995

[51] Int. Cl.[6] ..... F16L 5/00

[52] U.S. Cl. ..... 137/360; 137/355.16; 137/355.23

[58] Field of Search ..... 137/355.16, 355.23, 137/360

[56] References Cited

U.S. PATENT DOCUMENTS

| | | | |
|---|---|---|---|
| 1,618,667 | 2/1927 | Melcher | 137/360 |
| 2,193,288 | 3/1940 | Liley | 137/360 |
| 3,283,093 | 11/1966 | Bishop | 137/360 |
| 3,391,875 | 7/1968 | Hamrick | 137/355.23 |
| 3,437,105 | 4/1969 | Stracek | 137/355.23 |
| 3,464,859 | 9/1969 | Hamrick | 137/355.23 |
| 3,591,889 | 7/1971 | Wisner | 137/606 |
| 3,875,593 | 3/1975 | Thornton, Jr. et al. | 32/22 |
| 5,113,546 | 5/1992 | Parent | 15/315 |
| 5,119,843 | 6/1962 | Keenan | 137/355.23 |
| 5,263,502 | 11/1993 | Dick | 137/360 |

*Primary Examiner*—A. Michael Chambers
*Attorney, Agent, or Firm*—A. Ray Osburn

[57] ABSTRACT

An access and storage device for a retractable vacuum cleaning hose for use in buildings having a central vacuum generating system, said device being adapted for installation within a partition wall or the like of the structure, with access being provided to the hose so that it may be withdrawn either to its full length or to any needed length for cleaning use and subsequently automatically retracted back through the wall onto the hose storage reel.

22 Claims, 6 Drawing Sheets

IN-WALL RETRACTABLE VACUUM CLEANING HOSE ACCESS AND STORAGE DEVICE

BACKGROUND OF THE INVENTION

1. Field

The field of the invention is central vacuum connecting and storage devices for vacuum cleaning hoses used in conjunction with central vacuum systems within building structures.

2. State of the Art

Central vacuum sources are utilized in many building structures, such as hotels, motels, office buildings and residences. The central vacuum source is connected by appropriate ducting to multiple outlets in various areas requiring vacuum cleaning. A vacuum cleaning hose must be stored conveniently near each outlet, and must connect with ducting from the central source when used for cleaning the adjacent area. Storage between uses is difficult, since to be effective, vacuum hoses must be of considerable length. The hoses may occupy closet space, or are often stacked in unsightly view. Considerable labor is needed to coil the hoses for compact storage in closets for example. And, it must then be laboriously unwound for connection to the central vacuum source for subsequent uses. Portable reels, such as found in U.S. Pat. No. 340,557, may be used to partially alleviate the hose storage problem. For subsequent use however, the vacuum hose must be laboriously unwound from the reel to provide access to both hose ends. Sometimes, a large windlass-like drum is provided upon which the vacuum hose is wound in two or more spiral layers, the winding necessarily aided by mechanical guiding apparatus. U.S. Pat. No. 5,119,843 discloses such a device which is further equipped with a constant force spring in the form of device which is further equipped with a constant force spring in the form of a coil. A central vacuum delivery duct, and one end of a vacuum hose for cleaning are both connected to the hub of a rotatable drum, the hose being wound about the drum for storage. Intended for heavy industrial application, this device is not suitable for residential in-wall use. A similar windlass drum type apparatus is disclosed in U.S. Pat. No. 4,346,675, which shows such a drum in conjunction with a vacuum blower and a dust and dirt deposit chamber. In U.S. Pat. No. 1,963,653, a wall mountable, coin operated, vacuum cleaning device is disclosed for use in hotel, bus station, or airport lavatories. The user may vacuum lint from clothing, for example. The device includes within itself a vacuum blower and deposit receptacle for the lint. A storage reel accepts a short hose wound in a single spiral from a hollow hub to an outer reel rim. The hose is withdrawn against a clock-type spring, charging it with stored energy which is subsequently used to rewind the hose upon the reel. The device as disclosed is not adapted for receiving vacuum from a central source nor for installation within a partition wall structure, nor could it hold longer and larger hoses as needed for cleaning of spacious areas.

A need therefore exists for an improved vacuum hose device for installation within walls of structures having central vacuum sources, providing for connection thereto, for storage of the hose, for easy access to the connected hose for use, and for easy re-storage after use.

BRIEF SUMMARY OF THE INVENTION

With the foregoing in mind, the present invention eliminates or greatly alleviates the foregoing disadvantages in central vacuum system cleaning hose connecting and storage devices, by providing a hose cabinet for installation framed within a studded partition wall of a building structure. A hose storage reel is mounted to rotate within the cabinet, and comprises a pair of parallel disc members secured spaced apart upon a central hub. The hub is journaled to rotate about a stub axle outstanding horizontally from a rear wall of the cabinet. An air passage within the hub is located forwardly from the axle joining portion, and a vacuum cleaning hose is wound in a single spiral about the hub between the discs. An arcuate air passage member joins the hub passage to the end of the hose. This member may be reversed upon installation for selective clockwise and counterclockwise winding of the vacuum hose upon the reel.

The hub passage is also connected to a central vacuum supply duct from the central vacuum source located in a remote part of the building structure. A vacuum duct member provided for this purpose is mounted to span between an axially outward opening of the hub passage and the near end of the vacuum supply duct, which enters the cabinet from within the partition wall structure. Holes are provided through the cabinet side, top and bottom walls, for the vacuum source connection, and for exit of the vacuum cleaning hose, as subsequently explained, near each of the four corners of the square cabinet.

Affixed to the vertical rear wall of the cabinet is a canister containing a spirally coiled spring, comprising a circular housing with central aligned perforations through its front and rear walls. The hub of the reel has an affixed boss extending rearwardly into the spring canister through the perforation in the foremost canister wall. The boss carries a preferably double lobed notch which engages the inner end of the coil spring. Rotation of the hub boss winds the spring thereabout producing tension within the coiled spring which is later utilized to rewind the hose upon the reel. The spring canister may be installed selectively for clockwise or counterclockwise rotation of the reel as the hose is drawn therefrom.

The hose is withdrawn from the reel through a hose outlet sleeve installed within one of the above mentioned holes in the cabinet walls. The sleeve connects with a hose access structure which has a hose access door opening to the exterior of the wall structure, urged toward closed position by a spring. Retraction of any desired length of hose withdrawn for use is prevented by the door which wedges against the outside wall of the hose, aided by the hose corrugations. The aforesaid hose exit structures may be provided as required to extract the hose either outwardly from the partition wall in which the reel is installed, or through a wall corner or door frame, as may be advantageous in the particular location of the installation.

Advantageously, electrical lead containing vacuum hoses for use with powered attachments may be accommodated. A spring leaf electrical contact terminal is mounted on the cabinet rear wall and is connected electrically to the building electrical wiring. The spring leaf contacts bear upon a number of concentric annular electrical contact rings installed upon a rearmost wall of the rotating hub. Inside the hub, the electrical leads of the hose are connected to the contact rings at a terminal post mounted on the hub.

It is therefore the principal object of the invention to provide an improved vacuum cleaning device for installation concealed out of sight within a wall of a building structure, by which a vacuum cleaning hose stored therein is connected to a central vacuum source, and from which an desired length of vacuum hose may be withdrawn for use, and into which the vacuum hose is retracted for storage after use.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
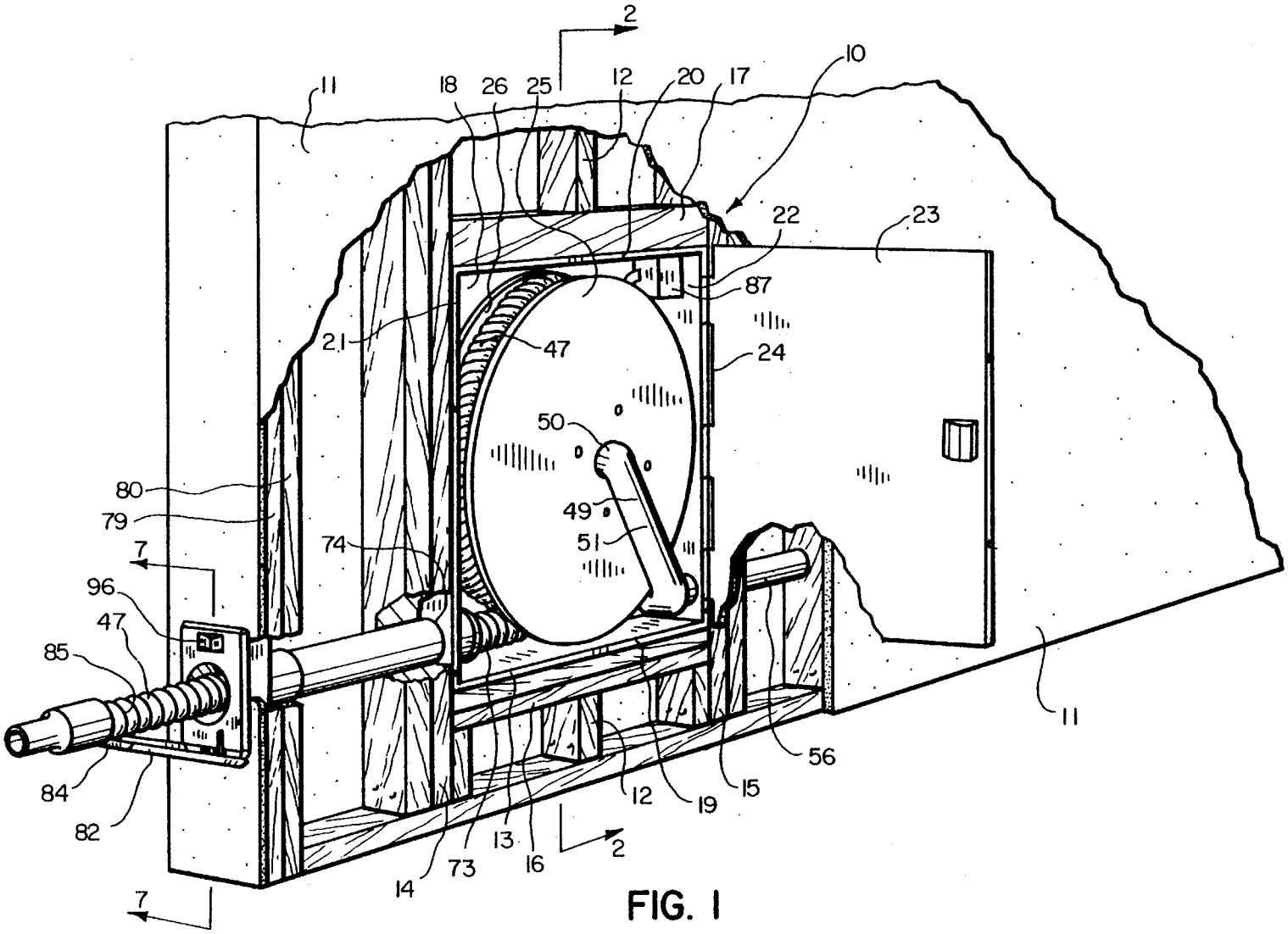
FIG. 1 is a perspective representation of an in-wall retractable vacuum cleaning hose access and storage device in accordance with the invention is shown installed within a partition wall of a building structure, the door of the cabinet of said device being open, and the wall structure being partially cut away to show details of hose guiding and access structures, and provisions for connection of the device to a vacuum duct from the central vacuum source of the building structure, drawn to a reduced scale, FIG. 2 a vertical cross sectional view of the cabinet and enclosed hose winding reel of the device, taken along line 2—2 of FIG. 1, drawn to a larger scale than that of FIG. 1, FIG. 3 a view of a fragment of the reel of the device of FIG. 1, showing the outwardly facing hub structure, along with fragments of an attached vacuum hose, and a fragment of the front disc of the reel assembly, drawn to approximately full scale, FIG. 4 a vertical section view taken through the spiral spring canister of the invention, along line 4—4 of FIG. 2, showing the spring thereof engaged by a rearwardly extending notched portion of the hub body, drawn to approximately full scale, FIG. 5 a view of a fragment of the device of FIG. 1 as seen from the bottom in the area of connection to the central vacuum supply duct, showing the connection thereof with the vacuum duct of the device, drawn approximately full scale, FIG. 6 a perspective view of a fragment of an embodiment of the device of the invention wherein the hose and access structure opens perpendicularly to the wall structure through the side thereof, rather than from an end structure thereof as shown in FIG. 1, drawn to the scale of FIG. 1, FIG. 7 a cross sectional view of fragments of the device of FIG. 1, showing the hose access structure and the end of the hose guiding sleeve leading thereto from the reel, drawn to a somewhat enlarged scale FIG. 8 a vertical cross sectional view of a fragment of the hub structure of the invention positioned about the hub supporting stub axle secured outstanding from the rear wall of the cabinet of the invention, drawn to approximately full scale, and FIG. 9 a front elevation view of another embodiment of the hub structure of the invention, wherein a portion of the air passage through the hub is molded integrally with the body of the hub, drawn to approximately the scale of FIG. 3.

In FIG. 1, an in-wall vacuum cleaning hose access and storage device 10 in accordance with the invention is illustrated installed within a stud framed partition wall 11 of a residential structure. A vertical section of a stud 12 is removed to create a space for a sizeable cabinet 13 within wall 11 between the two adjacent vertical double studs 14 and 15. The remaining portions of stud 12 are supported by cross bracing members 16 and 17. Cabinet assembly 13 comprises a vertical rear wall member 18, from which outstand bottom, top and sidewall members 19, 20, 21 and 22 respectively. A front access door 23 is secured to sidewall 22 by hinges 24. The walls and door are preferably constructed of thin sheet metal.

The inside of cabinet 13 is occupied by a hose storage reel assembly 25, comprising a rearmost disc member 26 facing a front disc member 27. (FIGS. 1 and 2) A rigidly secured horizontal stub axle 28 outstands from rear wall 18, preferably through a stiffening plate 29. Discs 26 and 27 are each secured spaced apart on a central hub 30, as by screws 31 which engage internally threaded bores 32. (FIG. 3) Hub 30 carries an axle bore 33 accepting a brass bearing bushing 34 in turn accepting stub axle 28 thereinto. Hub 30 is prevented from moving off axle 28 by a washer 35 installed about an end portion 36 extending through bushing 34, retained by snap ring 38.

An elbow 40 provides an open passage partially through the forward portion of hub 30, with leg 41 directed coaxially outward of hub 30. (FIGS. 1 and 3) The remaining elbow leg 42 is directed radially outward of the hub. Leg 42 is joined by an arcuately formed duct member 43, which may be installed in selective reversed positions to provide selectivity in vacuum hose unwinding direction. Both duct section 43 and central elbow 40 are preferably of molded plastic, and are preferably joined by a suitable bonding material, not shown.

Elbow 40 and arcuate duct member 43 are retained together in selected position by interior walls 44 and 45 of hub 30, which outstand from the circular vertical rear wall 91 thereof, and are respectively shaped to conform to inside and outside shapes of the joined elbow 40 and duct 43. Both interior walls join with a cylindrical outer wall 46, about which a vacuum cleaning hose 47 is stored spirally coiled. When used or stored, hose 47 remains connected with end 48 of arcuate duct 43, directed tangentially to hub wall 46.

Figure 5:
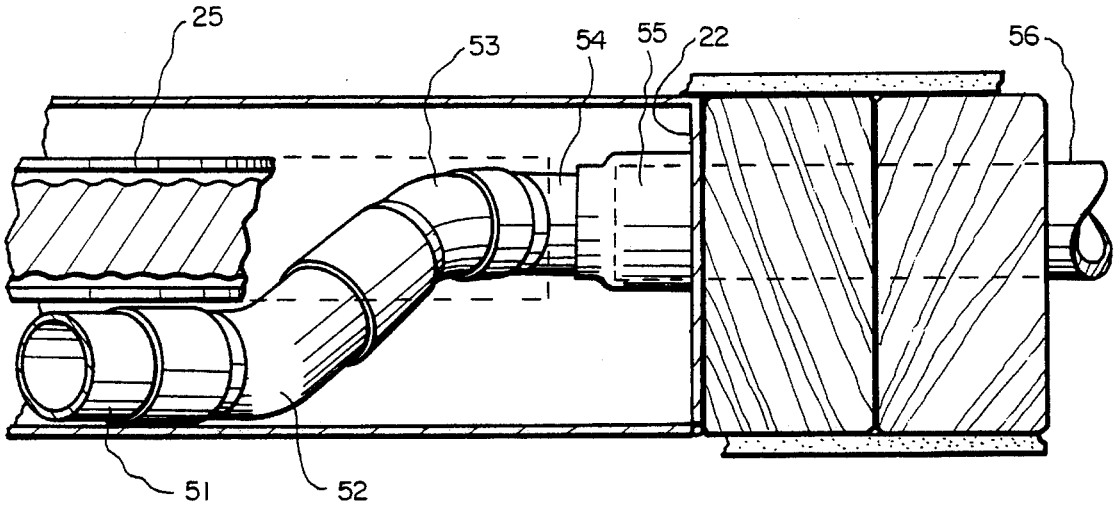

Connecting with axially directed leg 41 of central elbow 40 is a stationary vacuum supply duct assembly 49. Right angle elbow 50 is joined by an elongate duct portion 51 which runs parallel and closely adjacent to reel front disc 27, to join with another elbow 52 which bends inwardly to the cabinet into one of the corner areas thereof. Still another elbow 53 curves to meet an elbow 54 to which is secured a flared end member 55 directed perpendicularly to one of the walls near the corner. End elbow 54 and flared member 55 are fixedly secured together, but may be initially installed selectively rotated to elbow 53 to direct the flare perpendicularly to bottom wall 18 or sidewall 22. This facilitates connection with vacuum source supply duct 56 which enters cabinet 10 through hole 58 through the adjacent cabinet wall. (FIG. 5) Thus, vacuum duct 49 may be utilized selectively to meet vacuum supply duct 56 in the most convenient one of eight corner locations, as may be required for individual installations.

Figure 2:
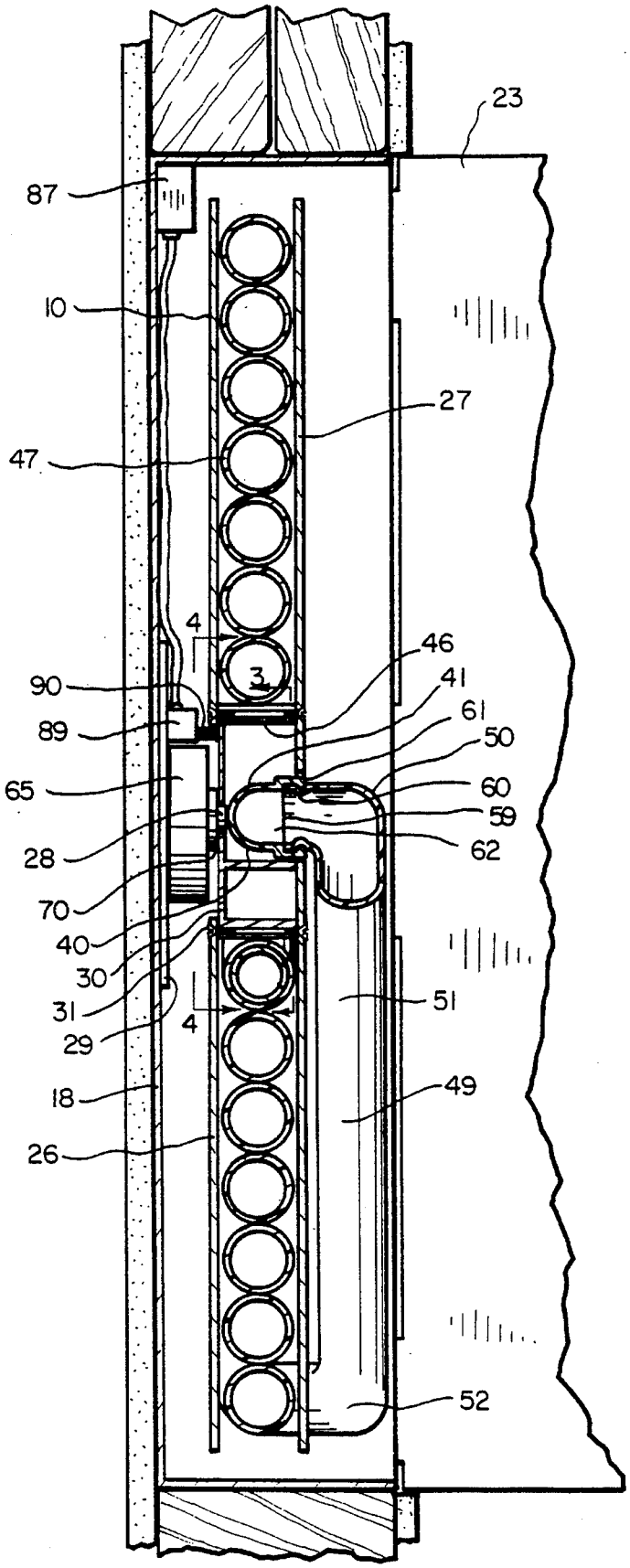
Figure 3:
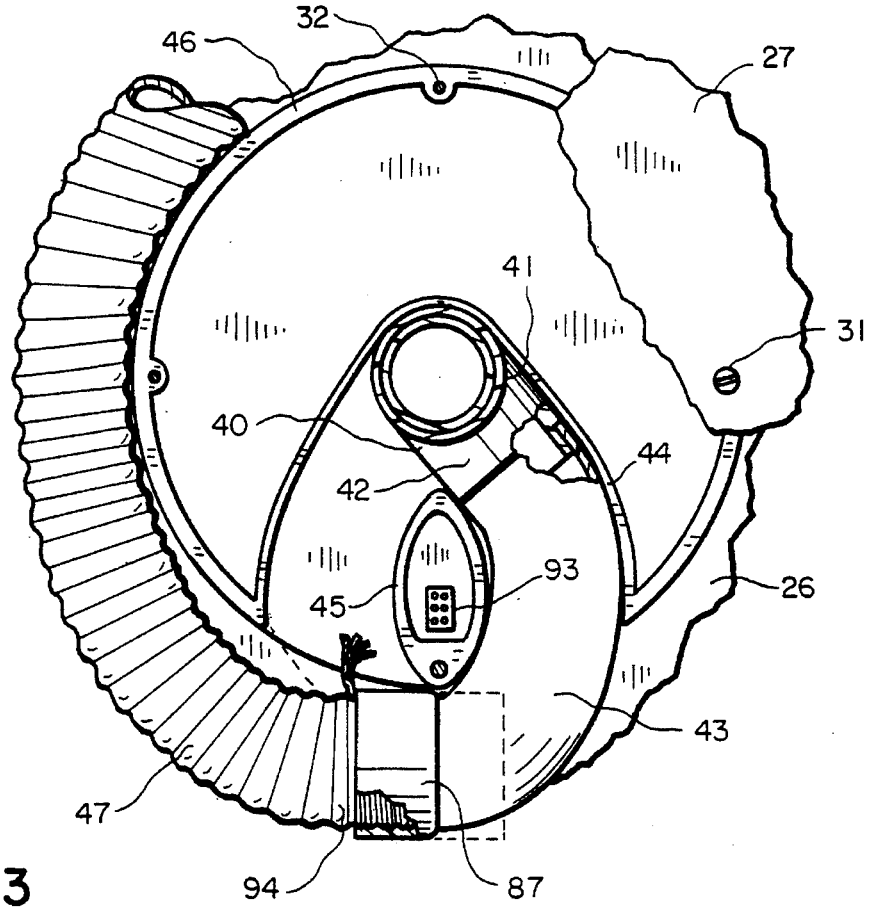
Figure 4:
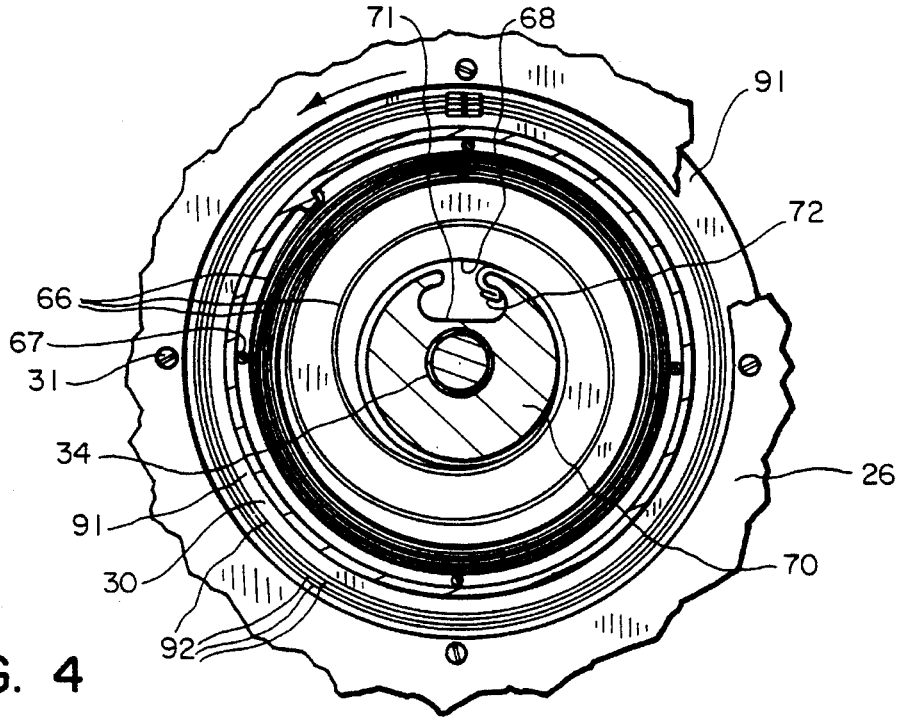

Vacuum supply duct assembly 49 is held stationary through its end connections, notwithstanding the rotation of reel assembly 25. The outstanding leg 41 of center elbow 40 accepts the inwardly facing end 59 of elbow 50 snapped thereinto, retained loosely by mating groove and projection 60 and 61 respectively. A shoulder 62 provides rotating contact area for end 59, pressed thereagainst by vacuum force during operation. (FIG. 2)

The flared end member 55 has an internal shoulder, not shown, against which the end of vacuum source duct 56 is pressed during operation.

Vacuum duct assembly 49, thus held stationary during operation, allows free rotation of reel 25 in clockwise or counterclockwise direction.

Figure 7:
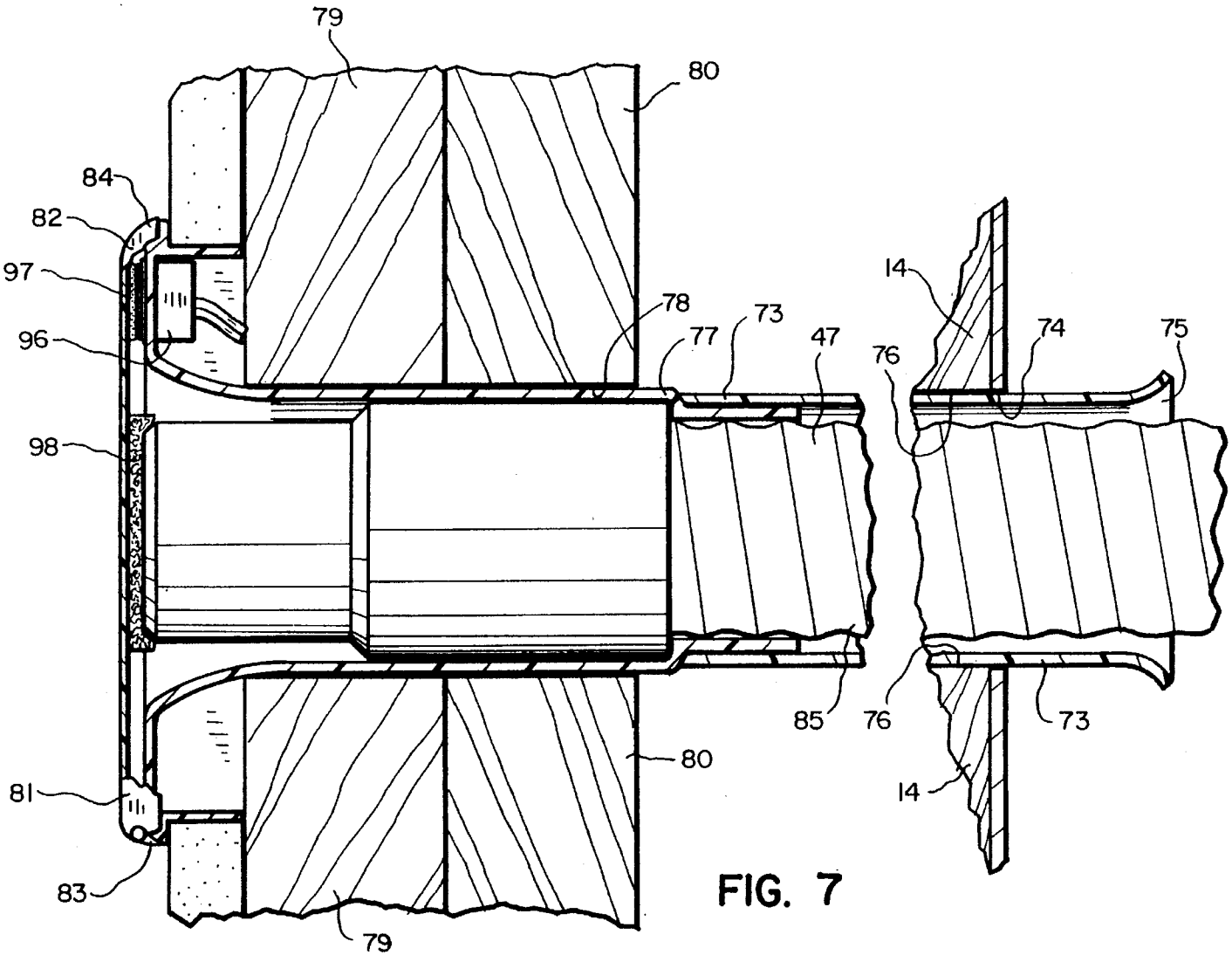
Figure 8:
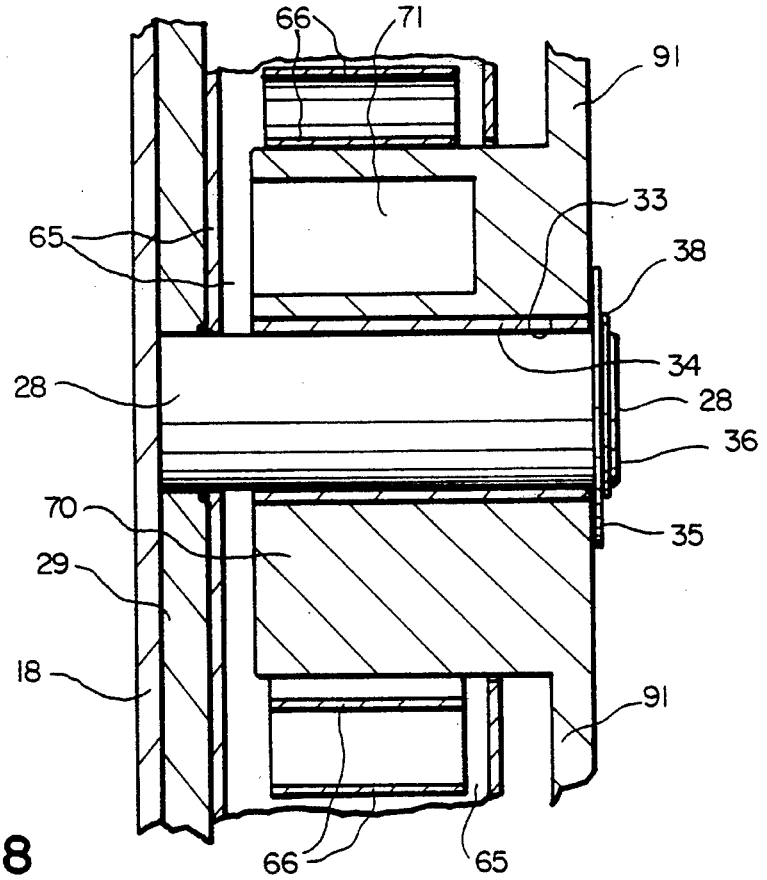

A circular canister 65 containing a spirally wound spring 66, is mounted as by bolts 67 to stiffening plate 29, aligned with axle 28 and hub 30. An axially centered front canister wall perforation 68 and a rear perforation, not shown, are each sized to accept a spring engaging boss 70 extending rearwardly from hub 30. (FIGS. 1 and 2) Boss 70 has a double lobed notch 71, as required to engage an inside end 72 of spring 66. As reel 25 rotates to allow hose 47 to be withdrawn, spring 66 is tensioned as it is wound about boss 70, storing energy for subsequent rewinding of the hose. The front and rear wall perforations permit spring canister 65 to be installed upon rear wall 18 reversed for either clockwise or counter-clockwise rotation of reel 25 as may be required in particular installations, with the end of spring 66 engaged by the appropriate lobe of notch 71. Preparatory to use directly or by connection to a cleaning implement, not shown, hose 47 is drawn from reel 25 through a sleeve assembly 73 installed extending through a hole 74 through one of the walls adjacent to one of the corners of the cabinet 13. (FIGS. 1 and 7) Rounded entrance 75 prevents snagging of hose 47 as it is withdrawn and retracted. The location of hole 74 within cabinet 13 is selected to facilitate individual installation.

Sleeve 73, in the embodiment of FIG. 1, extends through neighboring double stud 14 through a stud bore 76 to join with a sleeve 77 of access structure 81 which in turn extends through a bore 78 through wall corner studs 79 and 80, and the associated wall board. (FIG. 7) A sufficient length of vacuum hose 47 is pulled through structure 81, unwinding from reel 25, to reach the point of intended use.

Hose end access structure 81 has a hinged door 82 urged by a spring 83 (best seen in FIG. 1) toward closed position. When hose 47 is partially or fully extended, edge 84 of door 82 bears against hose corrugations 85 to prevent the hose from being retracted back into the wall and onto reel 25. (FIG. 1)

Figure 6:
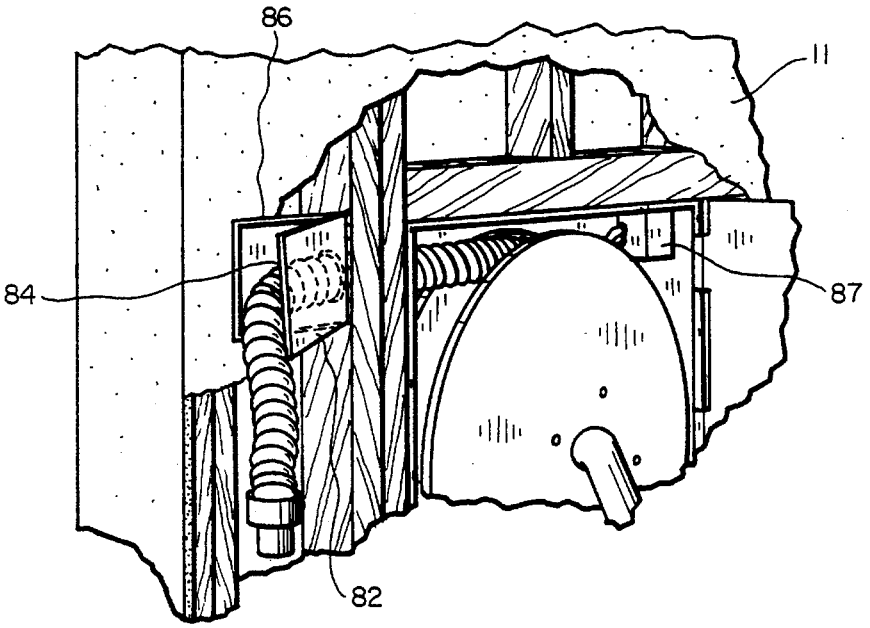

Hose end access structure 81 need not necessarily be located at a wall corner. For example, as illustrated in FIG. 6, such a structure may be located distantly from any corner. A box shaped hose end enclosure 86 occupies interior space in wall 11, with spring loaded door 82 opening outwardly. Edge 84 again prevents rewinding of hose 47 onto reel 25 unless released by user.

Preferably in-wall device 10 provides for use of vacuum hoses 41 incorporating electrical leads, such as may be needed, for example, for electrically operated "rug beater" cleaning implements. An electrical connection box 87 is mounted within cabinet 13, and is appropriately connected to the building structure electrical wiring. (FIGS. 1 and 3) Leads 88 from box 87 are connected with an electrical contact terminal 89 mounted on cabinet rear wall 18, having forwardly extending spring leaf contacts 90. On the vertical rear side of wall 91 of hub 30 are installed concentric annular electrical conducting rings 92, situated for sliding contact with the leaf contacts 90. Electrical leads, not shown, join rings 92 to an electrical terminal 93 on hub 30 near the innermost end 94 of hose 47, for connection of leads 95 extending from hose 47.

An on-off manual toggle switch 96 on hose end access structure 81 is connected by appropriate leads, not shown, to electrical connection box 87 and to terminal post 93 through leads 88. Switch 96 therefore simultaneously cuts or provides current to the hose leads and the central vacuum generator of the building structure. Spring loaded door 82 carries and elastic tab 97 positioned to press the "off" side of switch 96 when the door fully closes, so that the switch cannot inadvertently remain in the "on" position after rewinding of vacuum hose 47. Door 82 also has an inwardly facing elastic pad 98 to seal the end of hose 47 against any vacuum produced for use of another device 10 at a different location in the building structure.

Figure 9:
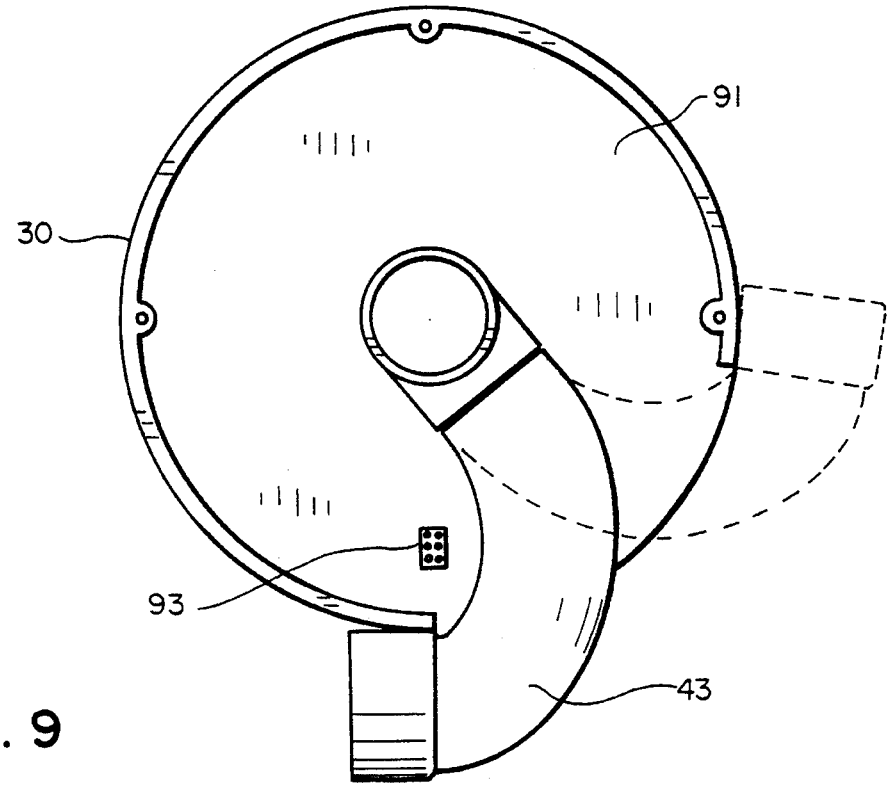

The invention may be expressed in different embodiments without departing from the essential spirit thereof. For example, passage within hub 30 as represented by elbow 40 may be replaced by a passage molded into the hub. (FIG. 9) If desired, the reversible arcuate member 43 may be used with such a molded hub embodiment reversibly to permit connection of the vacuum hose for clockwise or counter-clockwise unwinding.

Other means than the illustrated cabinet may be employed for mounting the reel assembly within the wall structure. For example, reel assembly 25 could be installed to rotate about axle 28 mounted outstanding from a plate member (not illustrated) provided to span between the vertical double studs 14 and 15.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description and all changes that come within the meaning and range of equivalency of the claims are therefore intended to be embraced therein.

What is claimed and desired to be secured by United States Letters Patent is:

1. For a building structure having at least one wall portion comprising studs and opposing side members thereof, a central vacuum generator connected by vacuum ducting to at least one location within the structure distant therefrom, a device at said location connecting a vacuum cleaning hose to the vacuum ducting, providing access to the hose for use and providing storage of the hose between periods of use thereof, said hose access and storage device comprising:

a vacuum cleaning hose reel assembly for storing hose wound thereabout, along with means for the mounting said assembly to rotate while contained entirely between opposite sides of the stud containing wall of the building structure, about an axis perpendicular to said wall;

means for connecting and end of an elongate vacuum cleaning hose to the reel assembly;

means for providing vacuum from said central vacuum generator ducting to said hose end;

means providing access to the other end of the hose from the outside of the wall, to draw the hose out of the wall from the reel, and means to return said hose into the wall to the rewound upon the reel for storage.

2. The vacuum cleaning hose access and storage device of claim 1, further comprising:

an axle member mounted within the wall of the building structure coaxially with the axis of rotation of the reel; wherein a central hub structure is journaled to rotate about the axle member, and having an open passage within said hub structure terminating at one end of the passage in a portion directed radially outward of the axis of rotation, and terminating at the other end thereof in a portion directed to be coaxial with said axis of rotation;

means for connecting an end of an elongate vacuum cleaning hose to the radially directed end portion of the passage; and means for connecting the central vacuum ducting to the portion of the passage which is coaxially directed to the hub; the reel assembly further comprising a pair of side discs secured to the hub structure to rotate therewith, and spaced apart to permit the vacuum cleaning hose to be wound spirally outward about the hub from an innermost end thereof connected to the radially directed end portion of the passage; and the reel structure further comprises means for causing rotation thereof to rewind the hose thereon after use.

3. The vacuum cleaning hose access and storage device of claim 2, wherein the means for mounting the reel assembly comprises:

a cabinet dimensioned to be installed within opposite sides of the stud containing wall of the building structure, the cabinet comprising a vertical rearmost wall with the axle member mounted outstanding forwardly therefrom, a bottom wall, a top wall and a pair of sidewalls outstanding therefrom, said walls joining to form four cabinet corners.

4. The vacuum hose access and storage device of claim 3, wherein the means for connecting the central vacuum ducting to the end of the coaxially directed portion of the hub passage comprises:

an open ended tubular member positioned at one end at the coaxial portion of the hub passage through a right angled end elbow and running parallel and closely adjacent to the foremost reel disc to the edge thereof in the vicinity of a selected corner of the cabinet formed by juncture of two of the walls thereof, and thereafter compoundly curving to an end portion perpendicular to one of the walls, and joining to the vacuum ducting at a hole provided through said wall.

5. The vacuum hose access and storage device of claim 3, wherein the vacuum hose end connection comprises:

an open ended tubular member joined to the radially directed end portion of the hub passage, said member having an arcuate portion and terminating in an end portion directed to be tangent to the hub structure, said end portion having means for connection of an end of the vacuum cleaning hose thereto.

6. The vacuum cleaning hose access and storage device of claim 3, wherein the hose end connection means and the means for connecting to the central vacuum supply respectively comprise:

an open ended tubular member joined to the radially directed end portion of the hub passage, said member having an arcuate portion and terminating in an end portion directed to be tangent to the hub structure, said end portion having means for connection of an end of the cleaning vacuum hose thereto; and an open ended tubular member positioned at one end at the coaxial portion of the hub passage through a right angled end elbow and running parallel and closely adjacent to the foremost reel disc to the edge thereof in the vicinity of a selected corner of the cabinet formed by juncture of two of the walls thereof, and thereafter compoundly curving to an end portion perpendicular to one of the walls, and joining to the vacuum ducting at a hole provided through said wall.

7. The vacuum cleaning hose access and storage device of claim 6, further comprising:

guide means directing the vacuum cleaning hose as it is unwound from the reel for use and subsequently rewound thereon for storage.

8. The vacuum cleaning hose access and storage device of claim 7, wherein the guide means comprises:

a guide sleeve piercing one of the wall members of the cabinet and extending to join with a structure providing access to the user end of the hose, said structure opening to the exterior of the building structure wall.

9. The vacuum cleaning hose access and storage device of claim 8, wherein the hose end access structure comprises:

a door secured by hinge means to open to the outside of the wall structure and urged by spring means toward a closed position thereof, an outermost edge of the door opposite the spring means being urged into contact with the vacuum cleaning hose as it is withdrawn for use.

10. The vacuum cleaning hose access and storage device of claim 9, further comprising:

a manual electrical toggle switch mounted upon the hose end access structure, electrically connected through building structure wiring to control the central vacuum generator, said switch being forced into "off" position by closing of the access structure door thereagainst after full retraction of the hose onto the reel after use.

11. The vacuum cleaning hose access and storage device of claim 9, wherein:

the vacuum cleaning hose when fully rewound upon the reel is positioned so that the user end thereof is sealed by the closed access structure door.

12. The vacuum cleaning hose access and storage device of claim 9, wherein the hub further comprises:

a terminal post for connection of electrical leads carried by the vacuum cleaning hose, said terminal post being electrically connected to electrical contact rings upon the rear surface of the vertical rear wall of the hub structure; and wherein spring leaf electrical contact points are mounted upon the rear wall of the cabinet and to bear against the contact rings.

13. The vacuum cleaning hose access and storage device of claim 6, wherein:

the hose rewinding means comprises spring means connected to the rearmost wall of the cabinet and to the hub structure, to be deflected by rotation of the reel, storing energy therein for said rewinding as the vacuum cleaning hose wound thereon is drawn from the reel for use.

14. The vacuum cleaning hose access and storage device of claim 13, wherein the spring means comprises:

a spirally coiled spring secured within a canister which is secured fixedly to the rearmost cabinet wall coaxially with the axis of rotation of the reel, the canister having a rearmost wall and a foremost wall each having a central aperture therethrough for access to the inside end of the spring; and wherein the hub structure further comprises a vertical rearmost wall and a spring engaging, rearwardly extending, boss coaxial with the axis of rotation of the reel, said boss being sized to extend through the aperture in the canister foremost wall, and being shaped to engage the innermost end of the coiled spring.

15. The vacuum cleaning hose access and storage device of claim 14, wherein:

the coiled spring containing canister may be installed so that the spring thereof may be selectively tensioned by clockwise or counterclockwise rotation of the reel as the hose is unwound.

16. The vacuum cleaning hose access and storage device of claim 14, wherein:

the open ended arcuate tubular member may be installed with the curve thereof directed as required for selective hose unwinding rotation of the reel in counterclockwise or clockwise direction; and the coiled spring container canister may be installed so that the spring thereof may be selectively tensioned by clockwise or counterclockwise rotation of the reel as the implement hose is unwound.

17. The vacuum cleaning hose access and storage device of claim 6, wherein the hub passage comprises:

a right angle tubular elbow mounted within the hub structure with one leg thereof directed coaxially with the hub structure, and the remaining leg thereof directed radially to the hub structure.

18. The vacuum cleaning hose access and storage device of claim 17, wherein:

the open ended arcuate tubular member may be installed with the curve thereof directed as required for selective hose unwinding rotation of the reel in counterclockwise or clockwise direction.

19. The vacuum cleaning hose access and storage device of claim 6, wherein:

the open ended arcuate tubular member may be installed with the curve thereof directed as required for selective hose unwinding rotation of the reel in counterclockwise or clockwise direction.

20. The vacuum cleaning hose access and storage device of claim 2, wherein the hub passage comprises:

a right angle tubular elbow mounted within the hub structure with one leg thereof directed coaxially with the hub structure, and the remaining leg thereof directed radially to the hub structure.

21. The vacuum cleaning hose access and storage device of claim 2, wherein:

the hub passage is molded integrally with the hub structure.

22. The vacuum cleaning hose access and storage device of claim 21, wherein:

the open ended arcuate tubular member may be installed with the curve thereof directed as required for selective hose unwinding rotation of the reel in counterclockwise or clockwise direction.

* * * * *